US011507126B2

(12) United States Patent
Choi

(10) Patent No.: US 11,507,126 B2
(45) Date of Patent: Nov. 22, 2022

(54) KNOB ASSEMBLY AND COOKING APPARATUS HAVING THE SAME

(71) Applicant: Samsung Electronics Co., Ltd., Suwon-si (KR)

(72) Inventor: Jeonghwan Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 189 days.

(21) Appl. No.: 17/098,068

(22) Filed: Nov. 13, 2020

(65) Prior Publication Data

US 2021/0223812 A1 Jul. 22, 2021

(30) Foreign Application Priority Data

Jan. 17, 2020 (KR) ..... 10-2020-0006822

(51) Int. Cl.

| | |
|---|---|
| ***G05G 1/12*** | (2006.01) |
| ***F24C 7/08*** | (2006.01) |
| ***G05G 1/02*** | (2006.01) |
| ***G05G 1/08*** | (2006.01) |

(52) U.S. Cl.

CPC ..... *G05G 1/12* (2013.01); *F24C 7/085* (2013.01); *G05G 1/02* (2013.01); *G05G 1/082* (2013.01); *G05G 2505/00* (2013.01)

(58) Field of Classification Search

CPC ..... G05G 1/08; G05G 1/082; G05G 1/10; G05G 1/12; G05G 1/087; H01H 3/08; H01H 3/10; H01H 2003/085; H01H 19/14; H01H 25/06

See application file for complete search history.

(56) References Cited

U.S. PATENT DOCUMENTS 5,356,285 A * 10/1994 Kim ..... F16K 31/52408 251/319
5,384,442 A * 1/1995 Danner ..... G05G 1/087 200/566
5,679,936 A * 10/1997 Schaeffer ..... H01H 3/022 200/17 R (Continued)

FOREIGN PATENT DOCUMENTS

DE 19951422 A1 * 5/2001 ..... B60K 37/06
DE 19960495 C1 * 9/2001 ..... F24C 7/083

(Continued)

OTHER PUBLICATIONS

Machine Translation of DE 10 2008 042 509.*

(Continued)

*Primary Examiner* — Richard W Ridley
*Assistant Examiner* — Brian J Mcgovern

(57) ABSTRACT

A cooking apparatus including a heating device, a regulating device including a regulating shaft and configured to control the heating device according to an operation of the regulating shaft, and a knob assembly provided to operate the regulating device. Where the knob assembly includes a knob body, a knob shaft coupled to the regulating shaft and a shaft holder provided to move together with the knob body. The shaft holder including a first shaft guide configured to guide the knob shaft to operate the regulating device and a second shaft guide configured to guide the knob shaft to prevent operation of the regulating device.

20 Claims, 11 Drawing Sheets

(56) References Cited

U.S. PATENT DOCUMENTS

| | | | | |
|---|---|---|---|---|
| 6,410,871 | B1 * | 6/2002 | Rarbach | G05G 1/087 200/566 |
| 8,434,199 | B1 | 5/2013 | Bowen et al. | |
| 2012/0125318 | A1 | 5/2012 | Cadima | |
| 2017/0307206 | A1 | 10/2017 | Yantis | |
| 2018/0010932 | A1 | 1/2018 | Bach | |
| 2019/0033908 | A1 | 1/2019 | Ha | |

FOREIGN PATENT DOCUMENTS

| | | | | |
|---|---|---|---|---|
| DE | 102008042509 | A1 * | 4/2010 | F24C 7/082 |
| DE | 202016001358 | U1 * | 5/2016 | F24C 15/00 |
| EP | 0366445 | A2 * | 10/1989 | G01G 1/10 |
| EP | 0671681 | A1 * | 9/1995 | G05G 1/08 |
| EP | 1526422 | A1 * | 4/2005 | G05G 1/087 |
| EP | 1857742 | A2 * | 11/2007 | F24C 15/10 |
| EP | 2469551 | A2 * | 6/2012 | F24C 3/126 |
| EP | 3462092 | A1 | 4/2019 | |
| EP | 3505829 | A1 | 7/2019 | |
| GB | 2236380 | A * | 4/1991 | D06F 34/30 |
| KR | 10-1997-0049234 | A | 7/1997 | |
| KR | 10-0135490 | B1 | 4/1998 | |
| KR | 10-1913927 | B1 | 10/2018 | |

OTHER PUBLICATIONS

Machine Translation of DE 20 2016 001 358.*
Machine Translation of DE 19951422.*
Machine Translation of DE 19960495.*
Machine Translation of EP 1526422.*
Machine Translation of EP 1857742.*
International Search Report of the International Searching Authority in connection with International Application No. PCT/KR2020/014816 dated Feb. 22, 2021, 4 pages.

* cited by examiner

KNOB ASSEMBLY AND COOKING APPARATUS HAVING THE SAME

CROSS-REFERENCE TO RELATED APPLICATION

This application is based on and claims priority under 35 U.S.C. § 119 to Korean Patent Application No. 10-2020-0006822, filed on Jan. 17, 2020 in the Korean Intellectual Property Office, the disclosure of which is incorporated herein by reference.

BACKGROUND

1. Field

The disclosure relates to a cooking apparatus, and more specifically, to a cooking apparatus having a knob assembly.

2. Description of the Related Art

In general, a cooking apparatus is a household appliance that includes a cooking chamber, a heating device that applies heat to the cooking chamber, and a circulation device that circulates heat generated by the heating device in the cooking chamber. The cooking apparatus is designed to seal and heat food and cook the food, and generally be classified into an electric type cooking apparatus, a gas type cooking apparatus, and an electronic type cooking apparatus according to a heating source of the heating device. For example, an electric oven may use heat from a heater driven by electricity as a heating source, a gas oven may use heat from a gas as a heating source, and a microwave oven may use frictional heat of water molecules due to high frequency as a heating source.

The cooking apparatus may be provided with a control panel that is formed on a front surface or an upper surface of a main body. The control panel may be provided with a plurality of buttons, a keypad, and/or a knob assembly configured to set a cooking mode desired by the user or to set various conditions required for cooking.

A regulating device that controls the heating device may be operated in a push and turn manner. The knob assembly provided to operate the regulating device may regulate the operation of the cooking apparatus in a two-step mechanism of pressing the knob assembly so that a regulating shaft of the regulating device is pressed and then turning the knob assembly.

On the other hand, the user may inadvertently operate the knob assembly, which may cause fire and/or burns.

SUMMARY

Therefore, it is an object of the disclosure to provide a cooking apparatus having a knob assembly capable of preventing an abnormal operation.

It is another object of the disclosure to provide a cooking apparatus having a knob assembly with improved safety in use.

Additional aspects of the disclosure will be set forth in part in the description which follows and, in part, will be obvious from the description, or may be learned by practice of the disclosure.

According to an aspect of the disclosure, there is provided a cooking apparatus including: a heating device; a regulating device including a regulating shaft and configured to control the heating device according to an operation of the regulating shaft; and a knob assembly provided to operate the regulating device, wherein the knob assembly includes: a knob body; a knob shaft coupled to the regulating shaft; and a shaft holder provided to move together with the knob body, and the shaft holder including a first shaft guide configured to guide the knob shaft to operate the regulating device and a second shaft guide configured to guide the knob shaft to prevent operation of regulating device.

The first shaft guide may be provided to guide the knob shaft when a pressing force is applied to the knob body, and the second shaft guide may be provided to guide the knob shaft when the pressing force and a turning force are applied to the knob body.

The second shaft guide may include: a second-a shaft guide provided to guide the knob shaft when the pressing force and the turning force are applied to the knob body in a first direction; and a second-b shaft guide provided to guide the knob shaft when the pressing force and the turning force are applied to the knob body in a second direction opposite to the first direction.

The knob assembly may include a shaft protrusion protruded from an outer circumferential surface of the knob shaft, and the first shaft guide and the second shaft guide are provided to guide the shaft protrusion.

The first shaft guide may have a groove shape into which the shaft protrusion is inserted, and the second shaft guide may have a slit shape configured to be slidable with respect to the shaft protrusion.

The shaft protrusion may include a material having a strength higher than a strength of the knob shaft.

The second shaft guide may have one end that is open such that the shaft protrusion is inserted into the second shaft guide when the knob shaft is coupled to the shaft holder.

The knob shaft may be configured to move together with the knob body when guided by the first shaft guide, and the knob shaft may be prevented from moving when guided by the second shaft guide.

The knob shaft may be provided to, when positioned on the first shaft guide, receive power transmitted from the shaft holder, and when positioned on the second shaft guide, receive no power from the shaft holder.

The second shaft guide may include: a movement preventing portion formed to extend in a direction that the knob body is pressed; and a rotation preventing portion formed to be inclined with respect to the movement preventing portion.

A length of the second shaft guide in a direction in which the knob body may is pressed may be larger than a length by which the knob shaft is moved by being guided by the first shaft guide.

The knob body may include an installation guide provided to guide the shaft holder to a coupling position, and the shaft holder may include a holder installation groove formed to correspond to the installation guide.

The knob assembly may further include a weight member fixed to the shaft holder and having a weight greater than a weight of the knob body.

The knob assembly may further include a leaf spring disposed on a portion of the knob shaft to which the regulating shaft is coupled.

The knob assembly may further include an elastic member provided to elastically support the knob body in a direction away from the knob shaft.

According to another aspect of the disclosure, there is provided a knob assembly including: a knob body; a shaft holder provided to move together with the knob body; and a knob shaft slidably coupled to the shaft holder, the knob shaft including a shaft protrusion protruded from an outer circumferential surface of the knob shaft, wherein the shaft holder includes: a first shaft guide configured to guide the shaft protrusion to cause power to be transmitted to the knob shaft; and a second shaft guide configured to guide the shaft protrusion to prevent power from being transmitted to the knob shaft.

The shaft protrusion may be guided by the first shaft guide when a pressing force is applied to the knob body, and guided by the second shaft guide when the pressing force and a turning force are applied to the knob body.

The shaft protrusion may include a material having a strength higher than a strength of the knob shaft.

The shaft holder may be provided to move together with the knob body when the shaft protrusion is guided by the first shaft guide, and move relative to the knob body when the shaft protrusion is guided by the second shaft guide.

The second shaft guide may include: a movement preventing portion formed to extend in a direction that the knob body is pressed; and a rotation preventing portion formed to be inclined with respect to the movement preventing portion.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
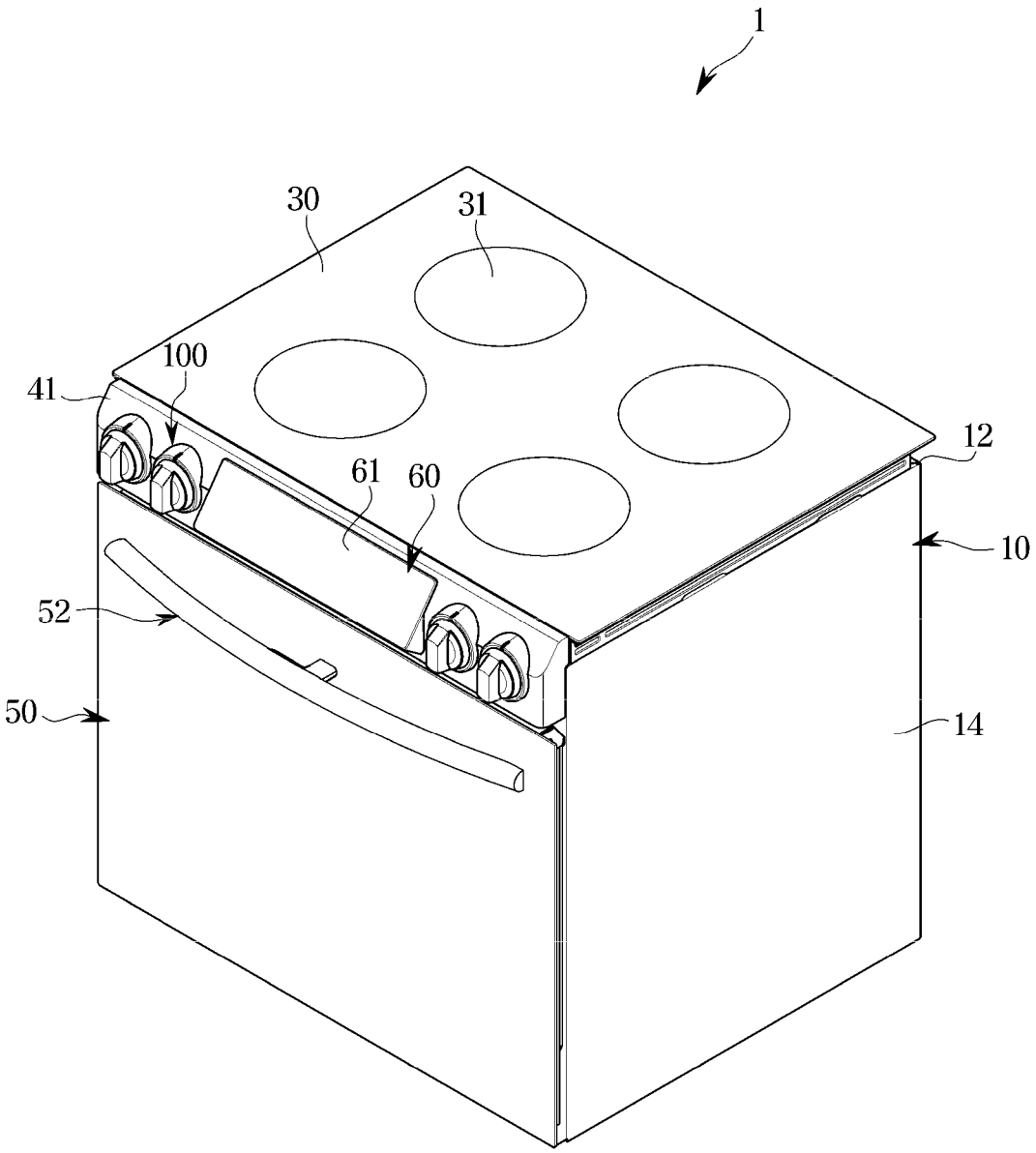
FIG. 1 is a view illustrating a cooking apparatus according to an embodiment of the disclosure.

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device The embodiments set forth herein and illustrated in the configuration of the disclosure are only the most preferred embodiments and are not representative of the full the technical spirit of the disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Hereinafter, embodiments of the disclosure will be described in detail with reference to the accompanying drawings. Hereinafter, a cooking apparatus 1 according to an embodiment of the disclosure is described in relation to an oven range including an oven as an example, but the embodiment of the disclosure may be applied even to a cooking apparatus that does not include an oven.

Figure 2:
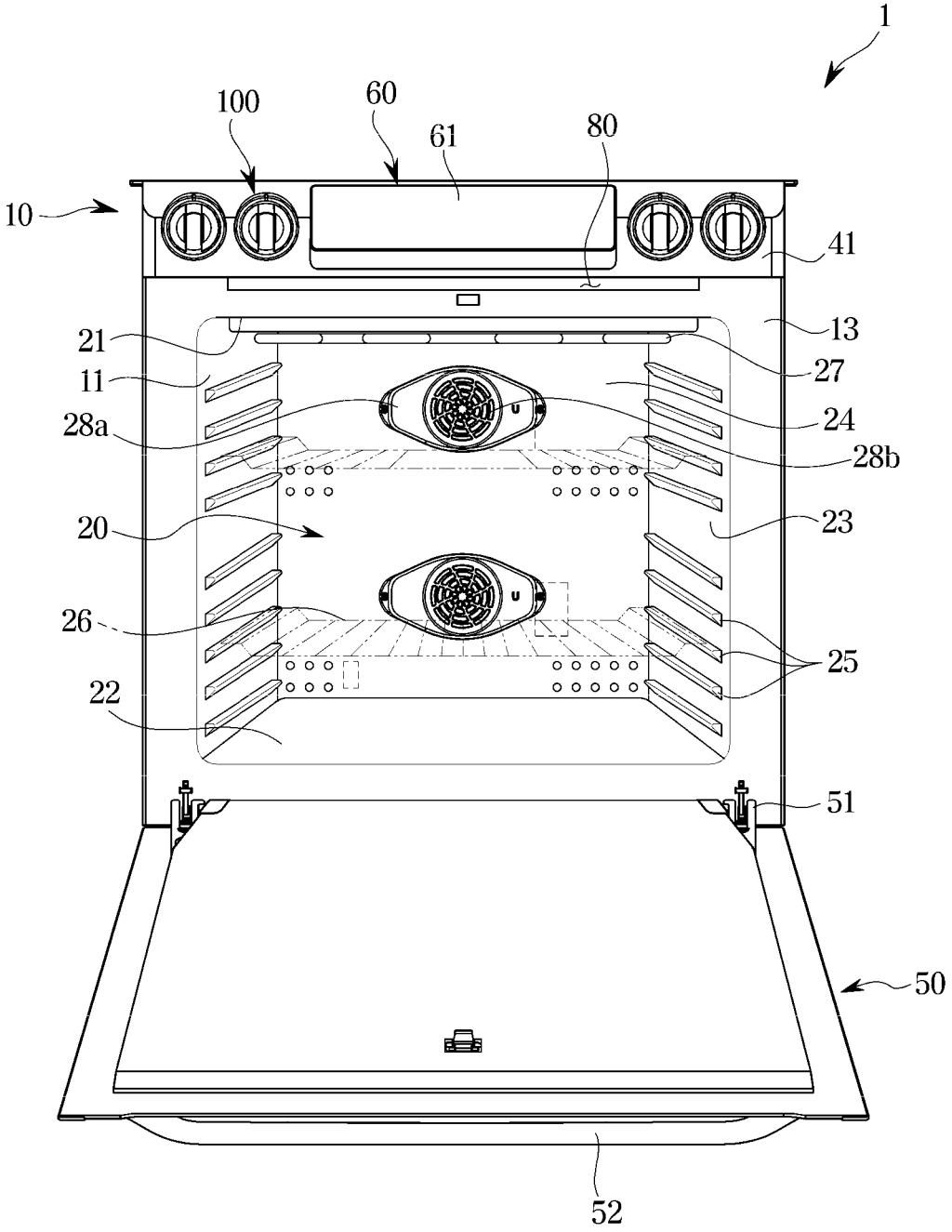
FIG. 2 is a view illustrating an open state of a door of the cooking apparatus shown in FIG. 1.
Figure 3:
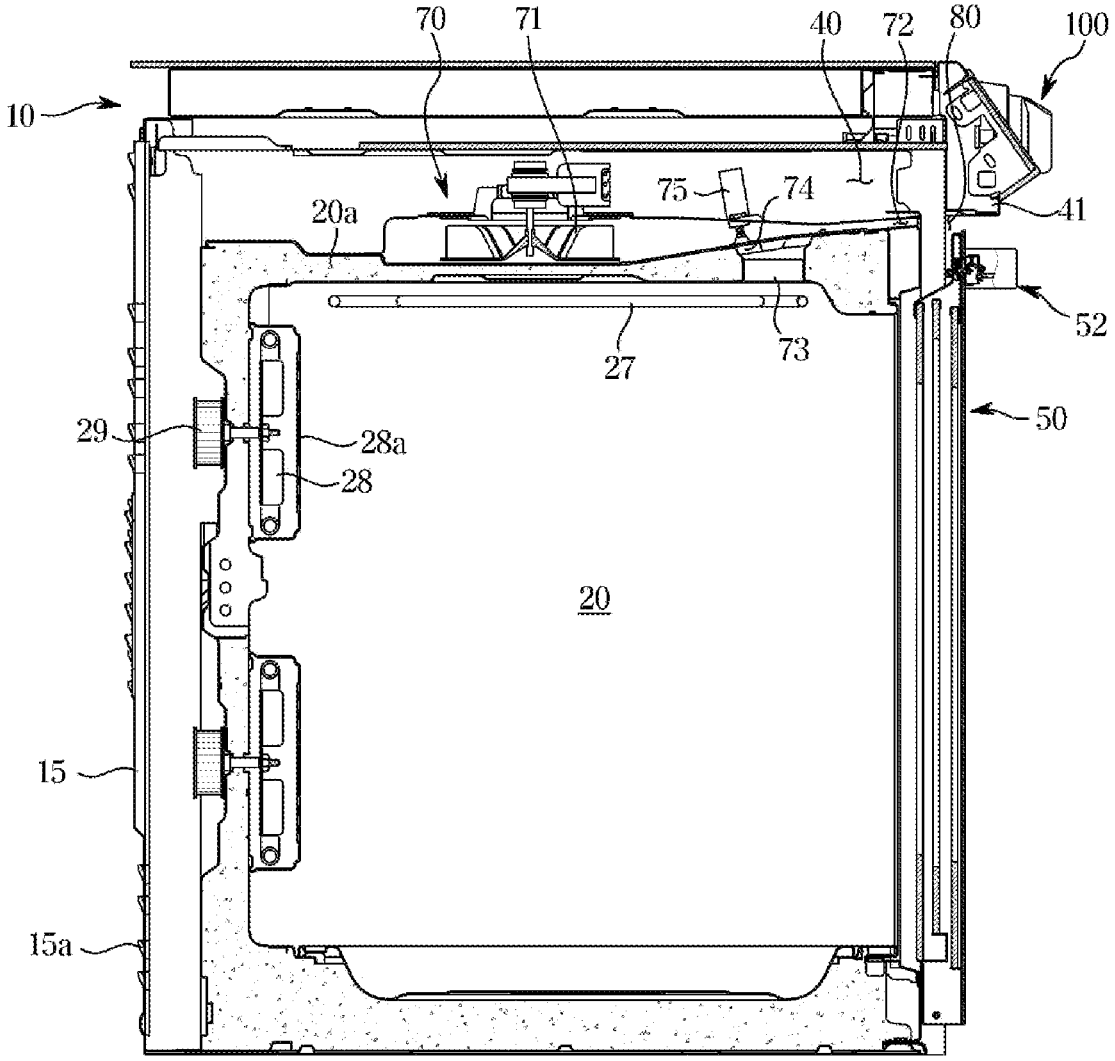
FIG. 3 is a side cross-sectional view illustrating the cooking apparatus shown in FIG. 1.

FIG. 1 is a view illustrating a cooking apparatus according to an embodiment of the disclosure. FIG. 2 is a view illustrating an open state of a door of the cooking apparatus shown in FIG. 1. FIG. 3 is a side cross-sectional view illustrating the cooking apparatus shown in FIG. 1.

Referring to FIGS. 1 to 3, the cooking apparatus 1 may include a main body 10 including an inner case 11 in which a cooking chamber 20 is formed and an outer case 12 coupled to the outside of the inner case 11 to form the external appearance of the cooking apparatus 1.

The inner case 11 and the outer case 12 may each have a substantially box shape with an open front surface.

The cooking apparatus 1 may include a cooktop 30 provided on the top of the cooking apparatus 1 and capable of heating a container placed thereon and containing food. The cooktop 30 may have at least one heating portion 31. The container containing a food may be placed on the heating portion 31 and directly heated.

The cooking apparatus 1 may include a door 50 provided on the front side of the main body 10 to open and close the cooking chamber 20.

The outer case 12 includes a front panel 13 forming a front surface of the main body 10, a side panel 14 forming a side surface of the main body 10, and a rear panel 15 forming a rear surface of the main body 10.

The front panel 13 is provided with an opening through which a front side of the cooking chamber 20 provided inside the main body 10 may be open. The outer case 12 may include a control panel 41 that is provided on an upper portion of the front panel 13 and covers a front surface of a machine room 40. A display module 60 may be mounted on the control panel 41.

The control panel 41 may be disposed on at least a portion of the main body 10. According to the embodiment of the disclosure, the control panel 41 may be disposed on one side of the front surface of the main body 10. However, the disclosure is not limited thereto, and the control panel 41 may be disposed on the upper surface of the main body 10 or may form one surface of the main body 10.

The rear panel 15 may be provided with an inlet 15*a* such that air is sucked into the machine room 40. Air sucked into the machine room 40 through the inlet 15*a* may flow inside the machine room 40 while cooling the electric parts. However, the position of the inlet 15*a* is not limited thereto, and the inlet 15*a* may be disposed at any position as long as it can suction external air and guiding the air to the machine room 40.

The cooking chamber 20 may be formed by a top plate 21, a bottom plate 22, side plates 23, and a rear plate 24. The cooking chamber 20 is a cooking space that is open forward through the opening of the front panel 13 so that food is put in or put out.

The side plates 23 may be provided with plurality of supports 25 at inner surfaces thereof. The plurality of supports 25 may have at least one detachable rack 26 such that food is placed on the at least one detachable rack 26.

On the plurality of supports 25, rails (not shown) may be installed such that the rack 26 is slidably moved. The user may move the rack 26 through the rail (not shown) to take out or place food.

On the plurality of supports 25, a divider (not shown) capable of dividing the cooking chamber 20 into a plurality of spaces may be detachably mounted. The plurality of spaces of the cooking chamber 20 does not need to have the same size, and may have different sizes from each other.

With such a configuration, the user may use the plurality of divided spaces of the cooking chamber 20 in various uses according to the intention. The divider may be formed of an insulating material to insulate each space of the cooking chamber 20.

A heater 27 for heating food may be provided in the cooking chamber 20. The heater 27 may be an electric heater including an electric resistor. However, the heater 27 is not limited thereto, and may be a gas heater that generates heat by burning gas. That is, the cooking apparatus 1 may include an electric oven or a gas oven.

The rear plate 24 of the cooking chamber 20 may be provided with a circulation fan 28 that circulates the air in the cooking chamber 20 so that food is heated evenly, and a circulation motor 29 that drives the circulation fan 28.

A fan cover 28*a* covering the circulation fan 28 may be provided in front of the circulation fan 28, and the fan cover 28*a* may be formed with an outlet hole 28*b* through which air may flow.

The open front of the cooking chamber 20 is opened and closed by the door 50, and the door 50 may be coupled to the main body 10 by a hinge 51 provided at a lower portion of the main body 10 so that the door 50 is rotated with respect to the main body 10.

A handle 52 gripped by a user to open and close the cooking chamber 20 by the door 50 may be provided on the front upper portion of the door 50.

The display module 60 provided to display various pieces of operation information of the cooking apparatus 1 and allowing a user to input an operation command may be mounted on the control panel 41 provided on the front upper portion of the front panel 13.

The display module 60 may include a liquid crystal display (LCD), and the LCD may display electrical information as visual information through a change in transmittance of liquid crystal molecules according to a voltage applied to the liquid crystal molecules. The LCD may include a liquid crystal module that displays an image and a light source unit that emits light to the liquid crystal module, and a light emitting diode (LED) may be used as the light source unit.

The display module 60 may include a cover panel 61 provided on the front surface of the LCD. The cover panel 61 may be a protective panel for simply protecting the LCD, or may be a touch panel capable of receiving a user's touch command.

A knob assembly 100 capable of operating the cooking apparatus 1 may be provided on the control panel 41. According to the embodiment of the disclosure, the knob assembly 100 may be provided in four units thereof. However, the disclosure is not limited thereto. Details of the knob assembly 100 will be described below.

Between the machine room 40 and the cooking chamber 20, an insulation material 20*a* that insulates the machine room 40 and the cooking chamber 20 is provided to prevent heat from the cooking chamber 20 from being transmitted to the machine room 40.

The heat insulating material 20*a* may not only cover between the machine room 40 and the cooking chamber 20 but also cover the entire outer side of the cooking chamber 20 so that the heat of the cooking chamber 20 is not transmitted to the outside of the cooking apparatus 1.

Since the internal temperature of the machine room 40 may rise due to the heat of various electric parts, the cooking apparatus 1 may be provided with a blowing device 70 that cools the machine room 40 by allowing air to circulate around the machine room 40.

The blowing device 70 may include a blower fan 71 for flowing air, and a discharge passage 72 provided to discharge air sucked by the blower fan 71 to the front of the cooking apparatus 1.

The blower fan 71 may suck air in the axial direction and then discharge the sucked air in the radial direction. That is, the blower fan 71 according to the disclosure may be a centrifugal fan. Alternatively, the blower fan 71 may include an axial fan.

External air may be sucked into the machine room 40 through the inlet 15*a* formed in the rear panel 15, and the air sucked into the machine room 40 may flow the inside of the machine room 40 while cooling the electric parts, and then by passing through an outlet 80 along the discharge passage 72, flows out to the front of the cooking apparatus 1.

The outlet 80 may include a space between the front panel 13 and the control panel 41. However, the disclosure is not limited thereto, and the outlet 80 may be provided in various positions and shapes as long as it can discharge air sucked through the inlet 15*a* to the outside of the main body 10.

A portion of the air inside the cooking chamber 20 may be sucked into the discharge passage 72 through a cooking chamber passage 73 and then flow to the front of the cooking apparatus 1.

The discharge passage 72 may be formed with a bypass hole 74 such that a portion of air flowing from the discharge passage 72 toward the outlet 80 is caused to flow into the cooking chamber passage 73, and the bypass hole 74 may be opened and closed by an opening and closing device 75.

With the opening and closing of the bypass hole 74 by the opening and closing device 75, the amount of a portion of air flowing from the discharge passage 72 to the outlet 80 which flows into the cooking chamber passage 73 is regulated, so that the amount of air exhausted to the cooking chamber passage 73 may be regulated.

The door 50 rotatably coupled to the front surface of the main body 10 to open and close the cooking chamber 20 may include a plurality of glasses. Spaces may be formed between the plurality of glasses, and allow external air to be introduced thereinto and circulate therein, thereby dissipating heat of the door 50.

Figure 4:
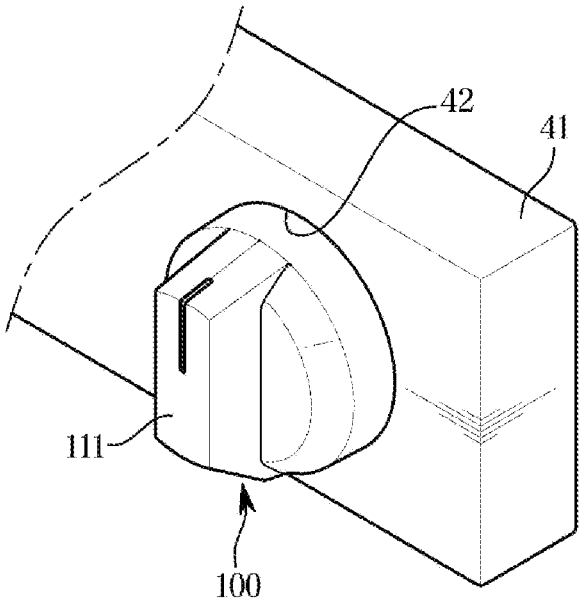
FIG. 4 is an enlarged view illustrating a portion of the cooking apparatus shown in FIG. 1 in which a knob assembly is disposed.
Figure 5:
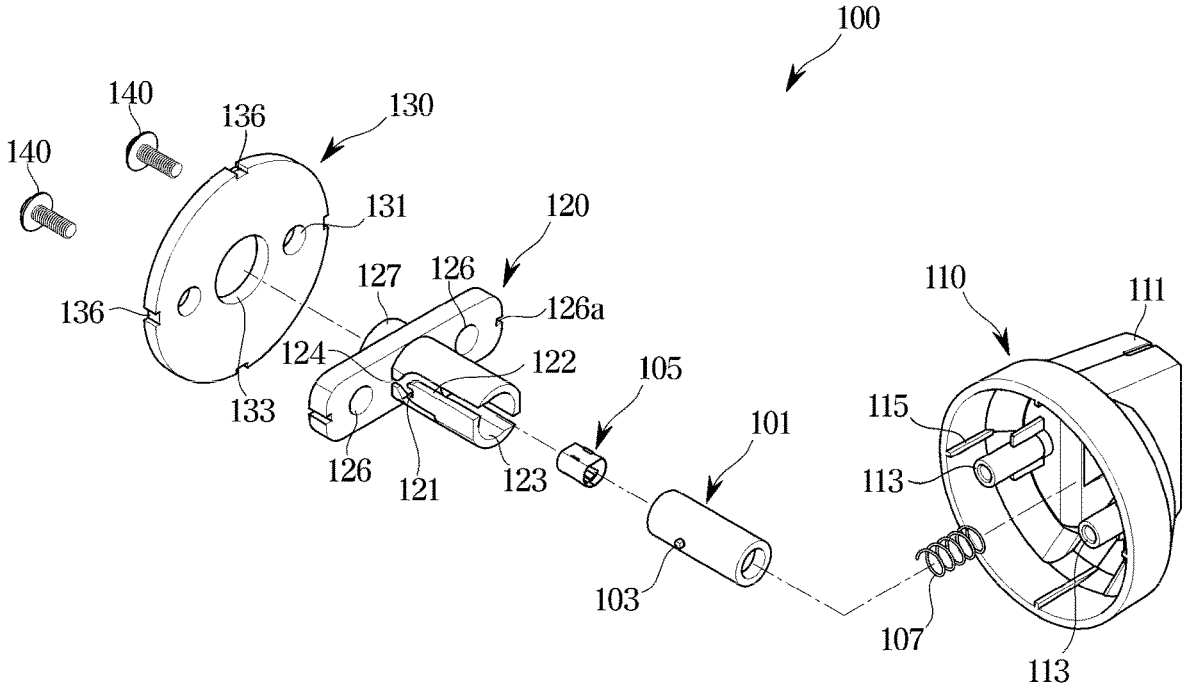
FIG. 5 is an exploded view illustrating the knob assembly shown in FIG. 4.
Figure 6:
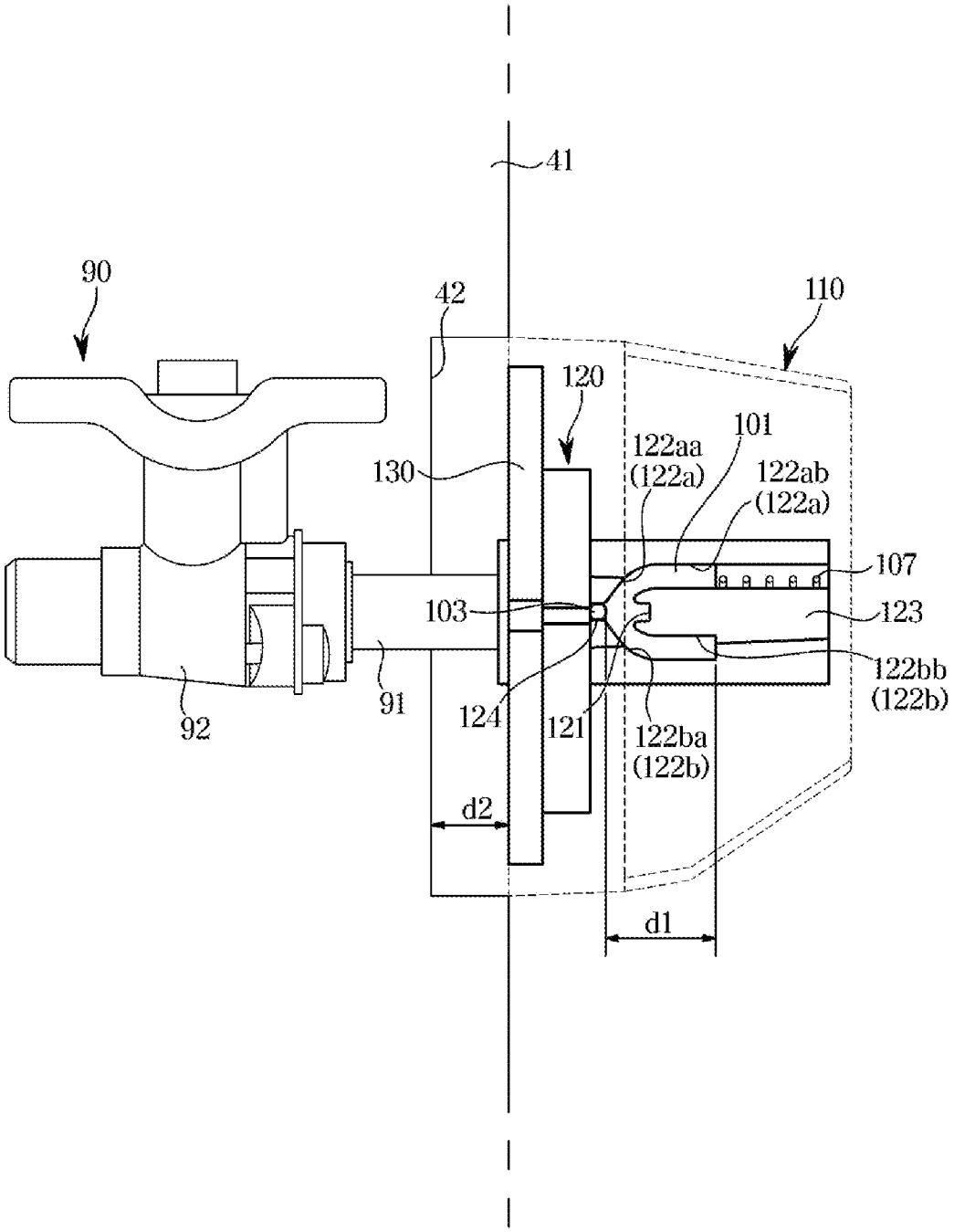
FIG. 6 is a view illustrating the inside of the knob assembly shown in FIG. 4.

FIG. 4 is an enlarged view illustrating a portion of the cooking apparatus shown in FIG. 1 in which a knob assembly is disposed. FIG. 5 is an exploded view illustrating the knob assembly shown in FIG. 4. FIG. 6 is a view illustrating the inside of the knob assembly shown in FIG. 4.

Referring to FIGS. 4 to 6, the cooking apparatus 1 may include a regulating device 90 disposed inside the main body 10. The regulating device 90 may include a regulating body 92 and a regulating shaft 91 provided to be insertable with respect to the regulating body 92. In other words, the regulating shaft 91 may be movably coupled to the regulating body 92.

The regulating device 90 may be configured to control the heating device of the cooking apparatus 1. The regulating device 90 may control the heating device as the regulating shaft 91 is rotated. The regulating device 90 may control the heating device in various modes as the regulating shaft 91 is rotated at different angles. The heating device may include a heating portion 31 of the cooktop 30 and a heater 27. For example, the regulating device 90 may control the on/off, temperature, etc. of the heating portion 31 (see FIG. 1) of the cooktop 30 (see FIG. 1), or the on/off, temperature, cooking time, cooking mode, etc. of the heater 27 (see FIG. 2).

The regulating shaft 91 may be movably and rotatably coupled to the regulating body 92. The regulating shaft 91 is rotatably coupled to the regulating body 92, but is prevented from being rotated unless being moved in a direction the regulating shaft 91 is inserted into the regulating body 92. As the regulating shaft 91 moves and rotates with respect to the regulating body 92, the regulating device 90 may control the operation of the heating device.

The cooking apparatus 1 may include the knob assembly 100 provided to operate the regulating device 90. When the regulating device 90 includes a valve, the knob assembly 100 may be provided to regulate the opening/closing degree of the valve of the regulating device 90. The knob assembly 100 may be provided on the control panel 41. The knob assembly 100 may move and rotate the regulating shaft 91 to operate the regulating device 90. The control panel 41 may include a knob groove 42 such that the knob assembly 100 may be moved and rotated. The knob assembly 1000 may slide with respect to the knob groove 42 and move and rotate.

The knob assembly 100 includes a knob shaft 101 coupled to the regulating device 90, a shaft holder 120 provided to be selectively interlocked with the knob shaft 101, and a knob body 110 to which the shaft holder 120 is fixed.

The knob shaft 101 may be fixed to the regulating shaft 91 of the regulating device 90. The knob shaft 101 may have a cross section, at least a portion of which is provided in an approximately D shape so that the knob shaft 101 may be rotated together with the regulating shaft 91. The regulating shaft 91 may be provided in a shape corresponding to that of the knob shaft 101. The shape of the cross section of the knob shaft 101 and the regulating shaft 91 is not limited thereto, and may have any shape as long as the knob shaft 101 and the regulating shaft 91 are interlocked with each other, such as a polygon or an ellipse.

The knob shaft 101 may be provided to interwork with the regulating shaft 91. Specifically, when the knob shaft 101 is moved in the front-rear direction, the regulating shaft 91 may move in the front-rear direction in conjunction with the knob shaft 101. When the knob shaft 101 is moved to the rear and then is rotated, the regulating shaft 91 may also be moved to the rear and then rotated. Without the knob shaft 101 being moved to the rear, even when a turning force is applied to the knob shaft 101, the knob shaft 101 and the regulating shaft 91 may be prevented from rotating.

The knob shaft 101 may include a shaft protrusion 103 protruding from an outer circumferential surface of the knob shaft 101. The shaft protrusion 103 may extend in the radial direction of the knob shaft 101. Since the shaft protrusion 103 is a part that transmits a force applied to the knob body 110 to the regulating shaft 91, the shaft protrusion 103 may include a material having a rigidity of a predetermined level or higher to ensure durability. The shaft protrusion 103 may be formed of a material different from materials forming other parts of the knob shaft 101.

The shaft protrusion 103 is provided to be engaged with a first shaft guide 121 of the shaft holder 120. The shaft protrusion 103 may be inserted into the first shaft guide 121. The shaft protrusion 103 may be inserted into a second shaft guide 122. The shaft protrusion 103 may be moved relative to the second shaft guide 122. When the shaft protrusion 103 is positioned on the first shaft guide 121, the shaft protrusion 103 may receive power from the shaft holder 120. When the shaft protrusion 103 is positioned on the second shaft guide 122, the shaft protrusion 103 may not receive power from the shaft holder 120 while moving relative to the shaft holder 120.

A leaf spring 105 may be provided at a portion of the knob shaft 101 where the knob shaft 101 is coupled to the regulating shaft 91. The leaf spring 105 may be provided to provide an elastic force between the knob shaft 101 and the regulating shaft 91 so that the knob shaft 101 may be firmly coupled to the regulating shaft 91. The leaf spring 105 may provide a coupling force between the knob shaft 101 and the regulating shaft 91.

The knob shaft 101 may be provided to have one end elastically supporting the knob body 110 and the other end connected to the regulating shaft 91. To this end, an elastic member 107 may be provided at the one end of the knob shaft 101 supporting the knob body 110. The elastic member 107 may have one end fixed to the knob shaft 101 and the other end opposite to the one end fixed to the knob body 110. The elastic member 107 may apply an elastic force to the knob body 110 in a direction in which the knob body 110 protrudes to the outside of the main body 10.

The shaft holder 120 may be fixed to the knob body 110. The shaft holder 120 may be interlocked with the knob body 110. The shaft holder 120 may include the first shaft guide 121 engaged with the knob shaft 101 to interwork with the knob shaft 101 and the second shaft guide 122 coupled to the knob shaft 101 not to interwork with the knob shaft 101.

The shaft holder 120 may include a shaft insertion portion 123 into which the knob shaft 101 is slidably inserted. The shaft insertion portion 123 may extend along a direction in which the knob shaft 101 presses the regulating shaft 91.

The shaft holder 120 includes a separation preventing portion 124 provided to support the shaft holder 120 to prevent the knob body 110 and the shaft holder 120 from being separated to the outside of the main body 10. When a pressing force is not applied to the knob body 110, the shaft protrusion 103 of the knob shaft 101 may be positioned on the separation preventing portion 124.

The first shaft guide 121 and the second shaft guide 122 may be formed on the outer circumferential surface of the shaft insertion portion 123.

The first shaft guide 121 is formed to be engaged with the shaft protrusion 103 of the knob shaft 101. The first shaft guide 121 may be positioned on the substantially same level as the separation preventing portion 124. The first shaft guide 121 may be provided to receive the shaft protrusion 103 when a pressing force is applied to the knob body 110. The first shaft guide 121 is provided in a shape surrounding the shaft protrusion 103 in which, when the knob body 110 receives a turning force, the shaft protrusion 103 is rotated so that the knob shaft 101 is rotated along with the shaft protrusion 103. The first shaft guide 121 may have a groove shape that is open at one side which the shaft protrusion 103 is inserted into or separated from.

The second shaft guide 122 may guide the shaft protrusion 103 so that the knob shaft 101 is prevented from moving when a pressing force and a turning force are simultaneously applied to the knob body 110. The second shaft guide 122 may have a slit shape. The second shaft guide 122 may be disposed to be spaced apart from the first shaft guide 121 along the circumferential direction of the shaft insertion portion 123.

The second shaft guide 122 may include a second-a shaft guide **122*a* formed to prevent movement of the knob shaft 101 when a turning force is applied to the knob body 110 in a first direction and a second-b shaft guide 122*b* formed to prevent movement of the knob shaft 101 when a turning force is applied to the knob body 110** in a second direction opposite to the first direction.

The second-a shaft guide **122*a* may be formed at one side of the first shaft guide 121 along the circumferential direction of the shaft insertion portion 123, and the second-b shaft guide 122*b* may be formed at the other side opposite to the one side of the first shaft guide 121 along the circumferential direction of the shaft insertion portion 123**.

The second-a shaft guide **122*a* may include a second-a rotation preventing portion 122*aa* formed from the separation preventing portion 124 to be inclined with respect to the direction in which the knob body 110 is pressed and a second-a movement preventing portion 122*ab* extending from the second-a rotation preventing portion 122*aa* along the length direction of the shaft insertion portion 123**.

The second-b shaft guide **122*b* may include a second-b rotation preventing portion 122*ba* formed from the separation preventing portion 124 to be inclined with respect to the direction in which the knob body 110 is pressed and a second-b movement preventing portion 122*bb* extending from the second-b rotation preventing portion 122*ba* along the length direction of the shaft insertion portion 123. The second-b rotation preventing portion 122*ba* may be formed to be symmetrical to the second-a rotation preventing portion 122*aa* about the length direction of the shaft insertion portion 123**.

The second-a shaft guide **122*a* may extend to an end portion of the shaft insertion portion 123 along the length direction of the shaft insertion portion 123. The end portion of the second-a shaft guide 122*a* may be open such that the shaft protrusion 103 is inserted into the end portion when the knob shaft 101 is inserted into the shaft insertion portion 123. The second-a shaft guide 122*a* is formed to extend to the longitudinal end portion of the shaft insertion portion 123 for assembly of the knob shaft 101**.

Unlike the second-a shaft guide **122*a*, the second-b shaft guide 122*b* may extend by a first length d1 along the longitudinal direction of the shaft insertion portion 123. The second-b shaft guide 122*b* may have a length shorter than that of the second-a shaft guide 122*a*. The first length d1 of the second-b shaft guide 122*b* may be formed to be greater than a second length d2 of the knob groove 42. Accordingly, in a state in which the shaft protrusion 103 is positioned on the second-b shaft guide 122*b*, even when a pressing force is applied to the knob body 110, the knob body 110 is moved by the second length d2 of the knob groove 42, and the shaft protrusion 103 is guided by the end of the second-b shaft guide 122*b*** to be prevented from being moved.

The shaft holder 120 may include a regulating device coupling portion 127 communicating with the shaft insertion portion 123. The regulating device coupling portion 127 may be located at the other end of the shaft insertion portion 123 that is opposite to one end facing the knob body 110. The regulating shaft 91 may be coupled to the knob shaft 101 at the regulating device coupling portion 127. The regulating shaft 91 may be fitted to the leaf spring 105 installed on the knob shaft 101 at the regulating device coupling portion 127.

The shaft holder 120 may include a holder fixing portion 126 to be fixed to the knob body 110. The holder fixing portion 126 may extend in a direction substantially perpendicular to the direction in which the shaft insertion portion 123 extends. The holder fixing portion 126 may be provided in plural. By positioning the holder fixing portion 126 to correspond to a body fixing portion 113 of the knob body 110, and then coupling a fastening member 140 to the holder fixing portion 126 and the body fixing portion 113, the shaft holder 120 may be fixed to the knob body 110.

The holder fixing portion 126 may include a holder installation groove **126*a* for guiding the shaft holder 120 to the coupling position when coupling the shaft holder 120 to the knob body 110. The holder installation groove 126*a* may be coupled to an installation guide 115 of the knob body 110. The holder installation groove 126*a* may be provided in a size, shape, and/or number corresponding to those of the installation guide 115**.

The knob body 110 may be fixed to the shaft holder 120. The knob body 110 may be disposed so that at least a portion of the knob body 110 protrudes from the control panel 41. At least a portion of the knob body 110 may be exposed to the outside of the main body 10.

The knob body 110 may include a knob handle 111 provided to be gripped by a user when operating the knob assembly 100. When the knob handle 111 is in an initial position in which the regulating device 90 is not operated, the knob handle 111 may have a shape extending substantially in the vertical direction. The knob handle 111 may protrude toward the front.

The knob body 110 may include the body fixing portion 113 fixed to the shaft holder 120 by the fastening member 140. The body fixing portion 113 may be provided to correspond to the holder fixing portion 126 of the shaft holder 120. When the fastening member 140 passes through the holder fixing portion 126 and then is coupled to the body fixing portion 113, the shaft holder 120 may be fixed to the knob body 110.

The knob body 110 may include the installation guide 115 provided to guide the shaft holder 120 to the installation position when the shaft holder 120 is installed. The installation guide 115 may protrude radially inward from the inner circumferential surface of the knob body 110 on which the shaft holder 120 is installed. In FIG. 5, a plurality of the installation guides 115 may be provided along the inner circumferential surface of the knob body 110, and the plurality of installation guides 115 may be disposed to be spaced apart from each other at approximately 90° intervals.

The knob assembly 100 may further include a weight member 130. The weight member 130 may be provided to have a weight of a predetermined size or more. The weight member 130 may be provided to improve a manipulation feeling when a user operates the knob assembly 100. The weight member 130 may be provided to correspond to the size and shape of an opening formed in the rear surface of the knob body 110 so as to cover the inner space of the knob body 110.

The weight member 130 may include a coupling hole 131 formed to allow the fastening member 140 to pass therethrough. The coupling hole 131 may be provided to correspond to a holder fixing portion 126 of the shaft holder 120. In a state in which the holder fixing portion 126 of the shaft holder 120 is aligned to correspond to the body fixing portion 113 of the knob body 110, and the coupling hole 131 is aligned to correspond to the holder fixing portion 126, when the fastening member 140 is sequentially coupled to the coupling hole 131, the holder fixing portion 126, and the body fixing portion 113, the weight member 130 is fixed to the holder fixing portion 126 and the knob body 110.

The weight member 130 may include a through hole 133 formed so that the regulating shaft 91 is coupled to the knob shaft 101. The regulating device coupling portion 127 of the shaft holder 120 may be inserted into the through hole 133.

The weight member 130 may include a member installation groove 136 for guiding the weight member 130 to the coupling position when the weight member 130 is coupled to the knob body 110. The member installation groove 136 may be coupled to the installation guide 115 of the knob body 110. The member installation groove 136 may be provided in a size, shape, and/or number corresponding to those of the installation guide 115.

The fastening member 140 may fix the shaft holder 120 and the weight member 130 to the knob body 110. The fastening member 140 may be provided as a screw.

Figure 7:
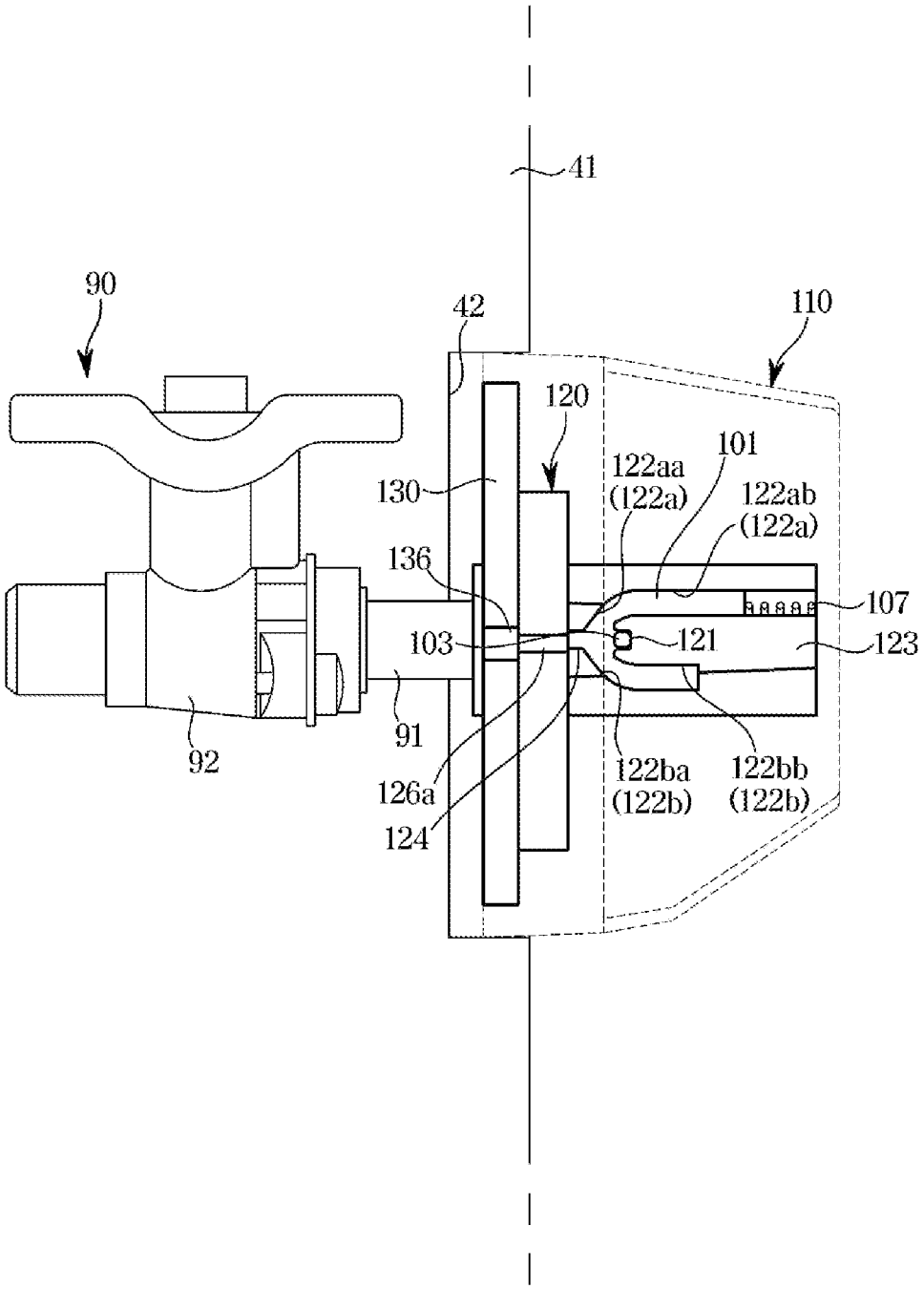
FIG. 7 is a view illustrating a process in which the knob assembly shown in FIG. 6 is normally operated.
Figure 8:
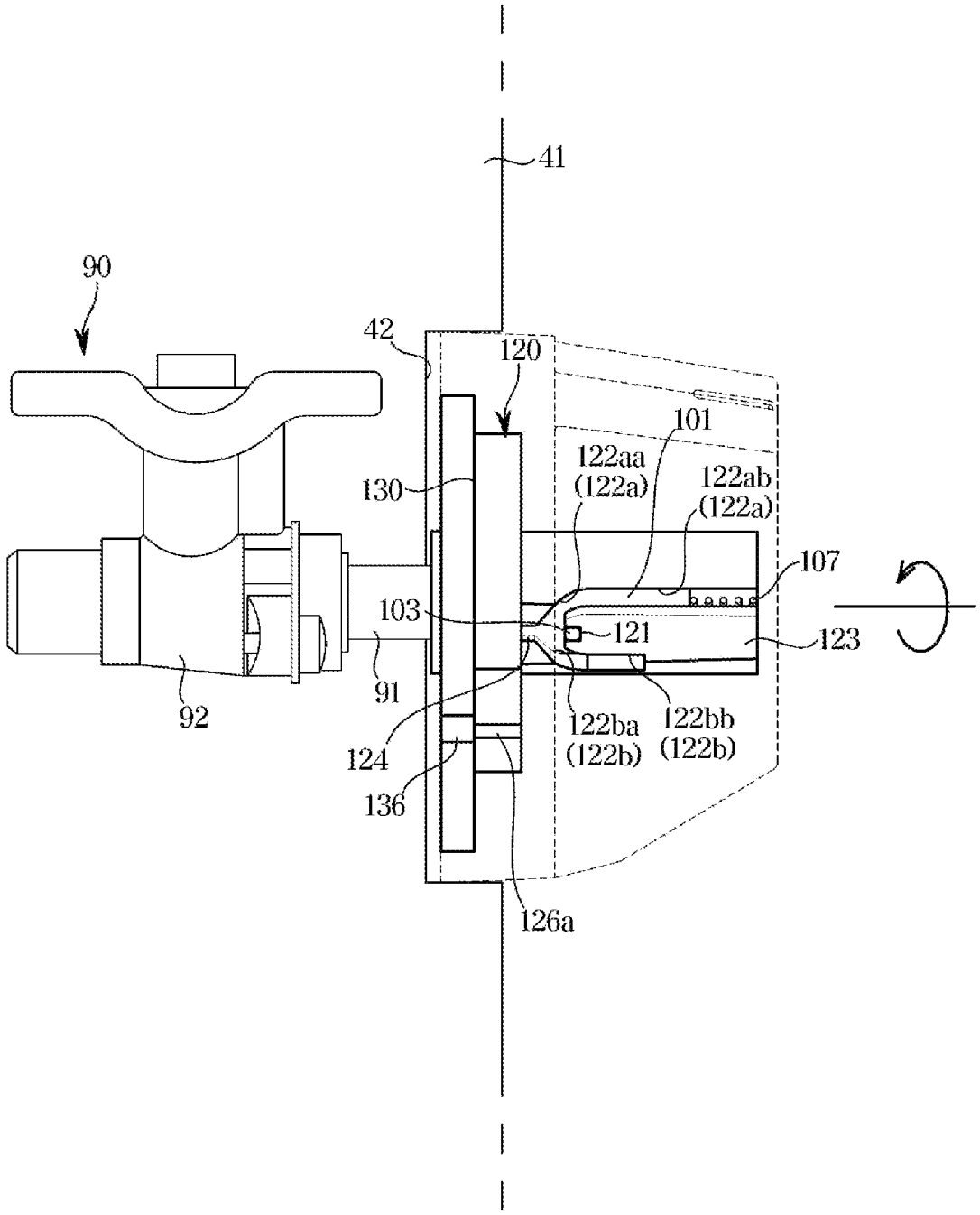
FIG. 8 is a view illustrating a process in which the knob assembly shown in FIG. 6 is normally operated.
Figure 9:
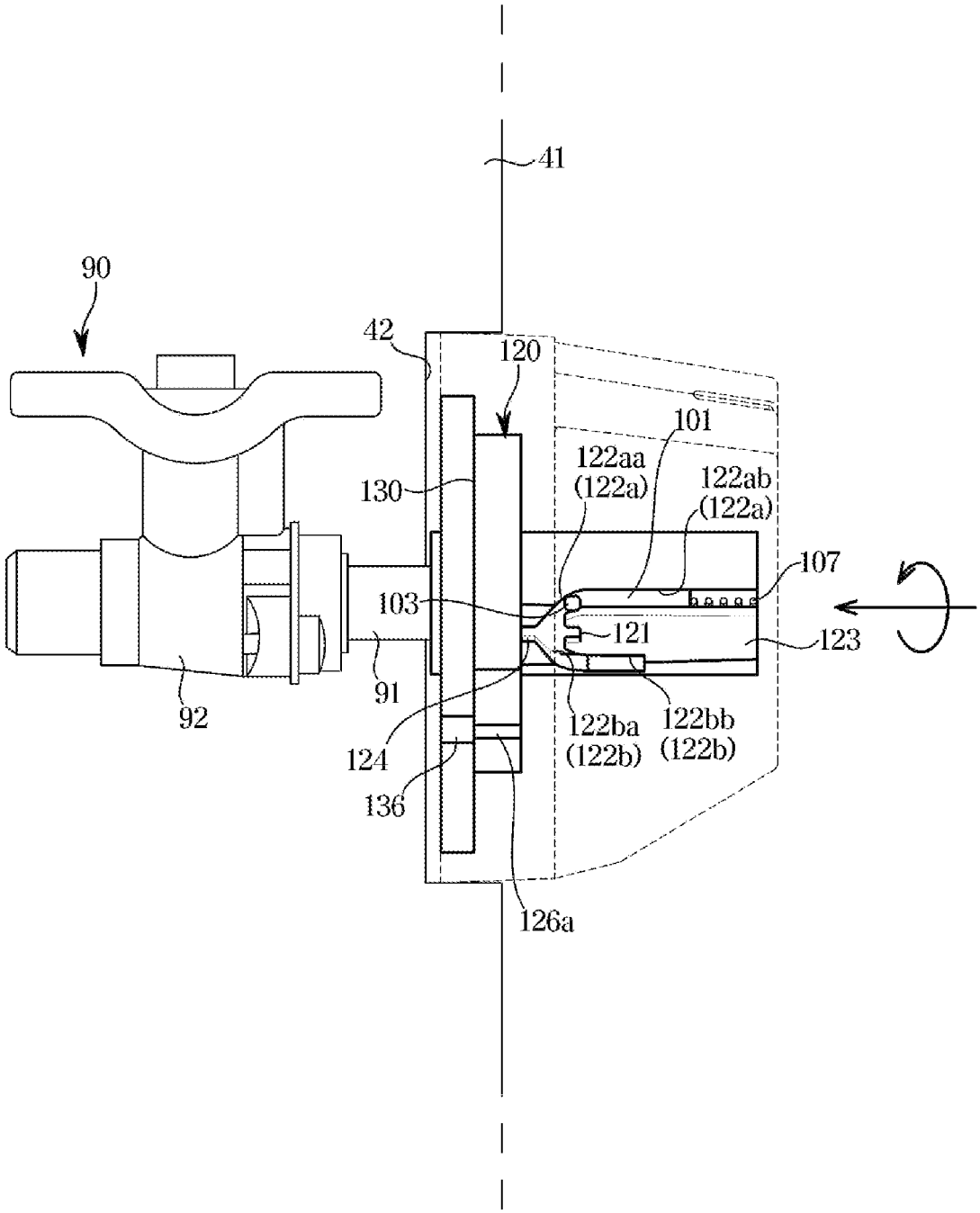
FIG. 9 is a view illustrating a process of preventing an abnormal operation of the knob assembly shown in FIG. 6.

FIGS. 7 and 8 are views illustrating a process in which the knob assembly shown in FIG. 6 is normally operated. FIG. 9 is a view illustrating a process of preventing an abnormal operation of the knob assembly shown in FIG. 6.

An operation of the knob assembly 100 according to the embodiment of the disclosure will be described with reference to FIGS. 6 to 9. FIG. 6 is a view illustrating a state in which a pressing force or turning force is not applied to the knob assembly 100.

Referring to FIG. 6, in a state in which a pressing force or turning force is not applied to the knob assembly 100, the knob body 110 is in a position withdrawn from the knob groove 42. Specifically, the elastic member 107 elastically supports the knob body 110 in a direction protruding from the control panel 41. The shaft protrusion 103 is caused to be positioned on the separation preventing portion 124. The shaft protrusion 103 supports the separation preventing portion 124 to limit the length of the knob body 110 being protruded to the outside of the control panel 41.

Referring to FIG. 7, when a pressing force is applied to the knob assembly 100, the knob body 110 moves in a direction that the knob body 110 is inserted into the knob groove 42. As the knob body 110 moves, the shaft holder 120 moves, and the movement of the shaft holder 120 causes the first shaft guide 121 to move to be engaged with the shaft protrusion 103. As the first shaft guide 121 is engaged with the shaft protrusion 103, the pressing force applied to the knob body 110 is transmitted to the knob shaft 101 through the shaft protrusion 103. Accordingly, the knob shaft 101 moves the regulating shaft 91 in a direction of operating the regulating device 90.

Referring to FIG. 8, after the regulating shaft 91 is pressed by the knob shaft 101, when a turning force is applied to the knob body 110, the shaft holder 120 rotates together with the knob body 110. As the shaft holder 120 rotates, the first shaft guide 121 rotates, and the rotation of the first shaft guide 121 causes the knob shaft 101, which is provided with the shaft protrusion 103 engaged with the first shaft guide 121, to rotate. As the knob shaft 101 rotates, the regulating shaft 91 is caused to rotate so that the regulating device 90 may operate the heating device.

Contrary to the user's intention, there may be a case where a pressing force and a turning force are simultaneously applied to the knob assembly 100. Such a situation may not be intended by the user, and when the control device 90 operates the heating device, an unexpected accident may occur.

Referring to FIG. 9, the knob assembly 100 according to the embodiment of the disclosure may be provided to prevent the regulating device 90 from operating in response to simultaneously receiving a pressing force and a turning force. Specifically, when a pressing force and a turning force are applied to the knob body 110 at the same time, the knob body 110 and the shaft holder 120 are rotated while being moved in a direction inserted into the knob groove 42. Accordingly, the shaft protrusion 103 of the knob shaft 101 is positioned on the second shaft guide 122 rather than the first shaft guide 121.

Specifically, as the shaft holder 120 is rotated while moving, the shaft protrusion 103 may be guided to the second-a rotation preventing portion 122*a*. When the knob body 110 is continuously pressed, the shaft protrusion 103 guided to the second-a rotation preventing portion 122*a* may be guided to the second-a movement preventing portion 122*ab*. That is, when the pressing force and the turning force are simultaneously applied to the knob body 110, the knob assembly 100 may prevent the knob shaft 101 from moving, so that the regulating device 90 may be prevented from being operated.

In addition, although not shown, even when a turning force is applied to the knob assembly 100 in a direction opposite to that shown in FIG. 9, the shaft protrusion 103 is guided to the second-b shaft guide 122*b*, so that the knob shaft 101 may be prevented from moving, and thus the regulating device 90 may be prevented from being operated.

With such a configuration, the cooking apparatus 1 according to the embodiment of the disclosure, when a pressing force and a turning force are simultaneously applied to the knob assembly 100 without intended by a user, may prevent the regulating device 90 from operating the heating device and causing a fire.

Figure 10:
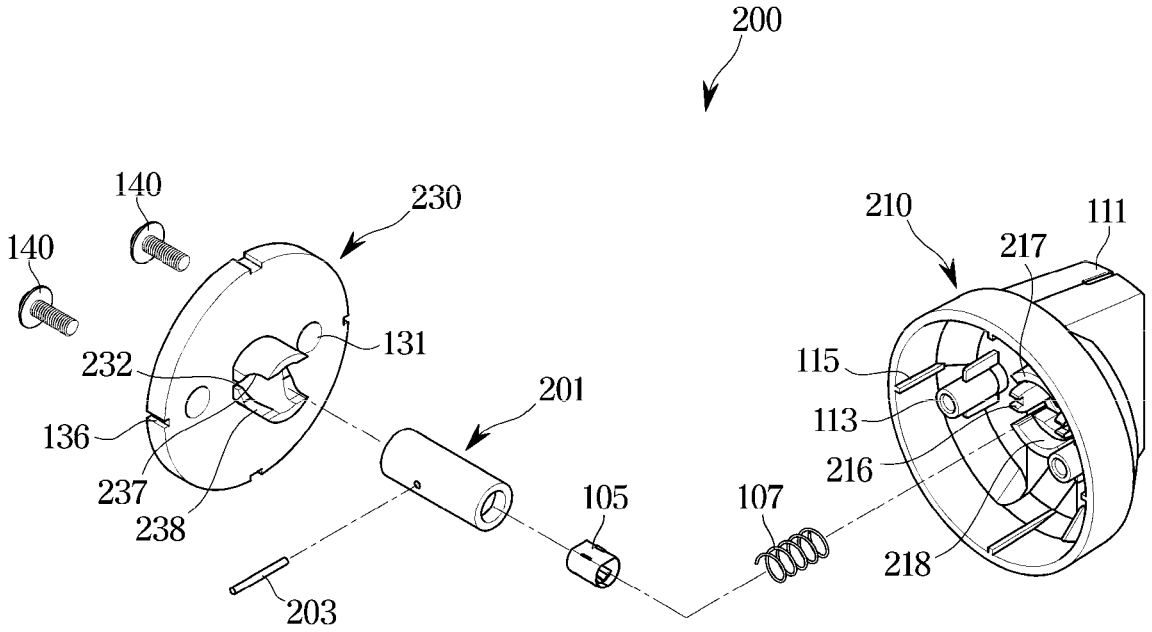
FIG. 10 is an exploded view showing a knob assembly according to another embodiment of the disclosure.
Figure 11:
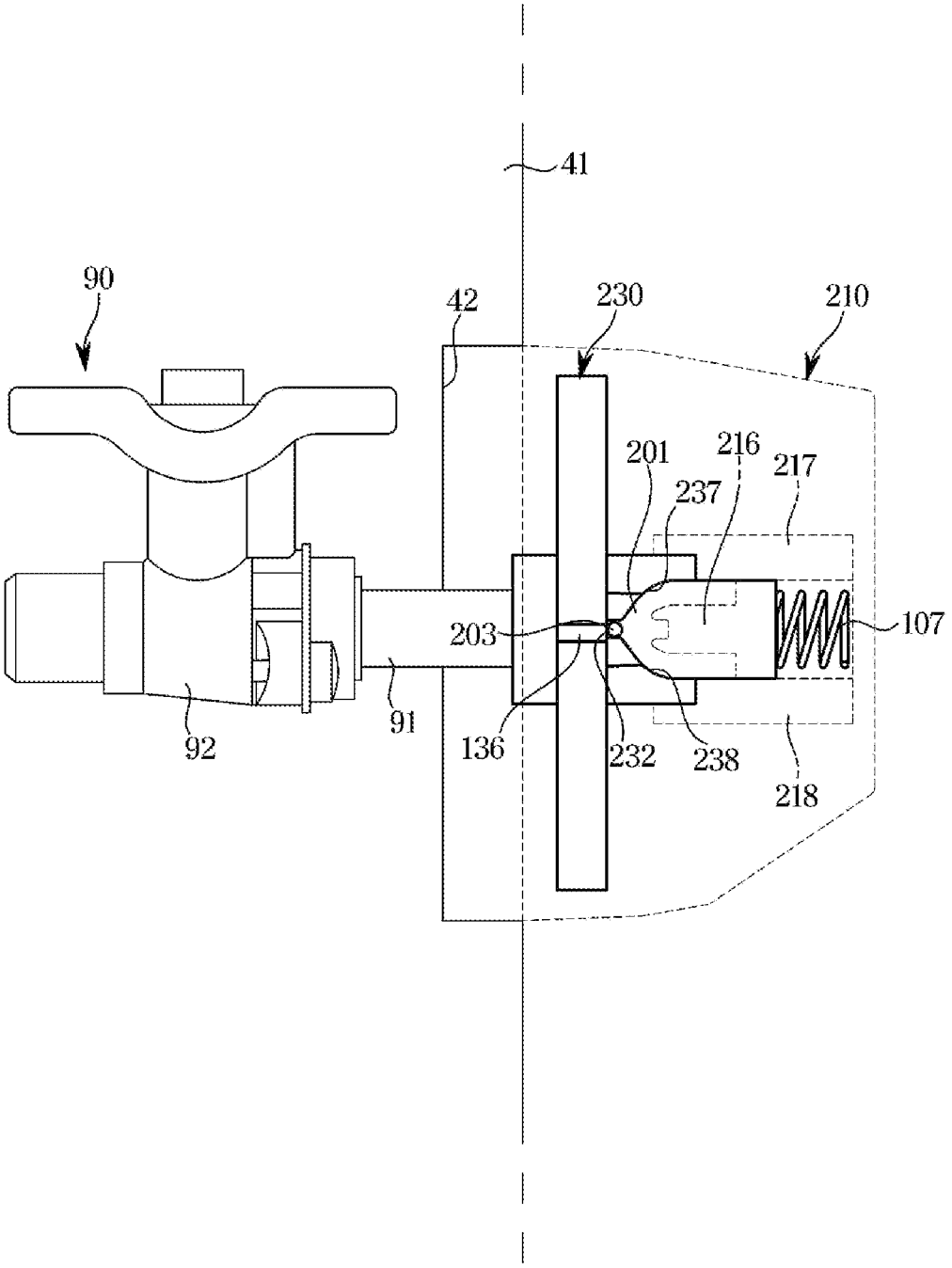
FIG. 11 is a view illustrating the inside of the knob assembly shown in FIG. 10.

FIG. 10 is an exploded view showing a knob assembly according to another embodiment of the disclosure. FIG. 11 is a view illustrating the inside of the knob assembly shown in FIG. 10.

A knob assembly 200 according to another embodiment of the disclosure will be described with reference to FIGS. 10 and 11. For the same components as those of the embodiment illustrated in FIGS. 4 to 6, the same reference numerals may be assigned and detailed descriptions thereof may be omitted.

Referring to FIGS. 10 and 11, the knob assembly 200 may include a knob shaft 201, a knob body 210, and a weight member 230.

A shaft protrusion 203 may be separably coupled to the knob shaft 201. The shaft protrusion 203 may be formed of a material having a rigidity of a predetermined size or more so as to ensure durability. The knob shaft 201 may be formed of a material different from that forming the shaft protrusion 203. A leaf spring 105 may be coupled to the inside of the knob shaft 201.

Unlike the knob assembly 100 illustrated in FIG. 5, the knob assembly 200 according to the embodiment of the disclosure may omit a separate component for guiding the knob shaft 201. Specifically, the knob assembly 200 according to the embodiment of the disclosure may have a structure for guiding the knob shaft 201 as the knob body 210 is coupled to the weight member 230. That is, one portion of a shaft holder may be integrally formed with the knob body 210, and the other portion of the shaft holder may be integrally formed with the weight member 230.

Specifically, a first shaft guide 216 may be formed in the knob body 210. The first shaft guide 216 may be positioned at an inner side of the knob body 210 facing toward the weight member 230. The first shaft guide 216 may extend from the inner surface of the knob body 210 toward the weight member 230.

The knob body 210 may be provided with a second-a movement preventing portion 217, and the weight member 230 may be provided with a second-a rotation preventing portion 237. When the weight member 230 is coupled to the knob body 210, the second-a movement preventing portion 217 and the second-a rotation preventing portion 237 may form a second-a shaft guide.

The knob body 210 may be provided with a second-b movement preventing portion 218, and the weight member 230 may be provided with a second-b rotation preventing portion 238. When the weight member 230 is coupled to the knob body 210, the second-b movement preventing portion 218 and the second-b rotation preventing portion 238 may form a second-b shaft guide.

A separation preventing portion 232 may be formed in the weight member 230.

That is, in the embodiment shown in FIGS. 10 and 11, the first shaft guide 216, the second-a movement preventing portion 217, the second-a rotation preventing portion 237, the second-b movement preventing portion 218, the second-b rotation preventing portion 238, and the separation preventing portion 232 may form a shaft holder. In the embodiment illustrated in FIGS. 10 and 11, the shaft holder is defined as a portion including the first shaft guide 216, the second-a movement preventing portion 217, the second-a rotation preventing portion 237, the second-b movement preventing portion 218, the second-b rotation preventing portion 238, and the separation preventing portion 232 when the knob body 210 is coupled to the weight member 230.

With such a configuration, unlike the knob assembly 100 shown in FIGS. 4 to 9, the knob assembly 200 according to the embodiment of the disclosure may perform the same operation as the knob assembly 100 shown in FIGS. 4 to 9 while omitting the shaft holder.

Specifically, when a pressing force and a turning force are not applied to the knob assembly 200, the shaft protrusion 203 may be positioned on the separation preventing portion 232.

When a pressing force and a turning force are sequentially applied to the knob assembly 200, the shaft protrusion 203 is engaged with the first shaft guide 216, so that the knob shaft 201 moves and rotates together with the knob body 210. Accordingly, the knob shaft 201 moves and rotates the regulating shaft 91, and the regulating device 90 operates the heating device.

When a pressing force and a turning force are simultaneously applied to the knob assembly 200, the shaft protrusion 203 may be guided to the second-a rotation preventing portion 237 or the second-b rotation preventing portion 238. The shaft protrusion 203 guided to the second-a rotation preventing portion 237 may be guided to the second-a movement preventing portion 217, and the shaft protrusion 203 guided to the second-b rotation preventing portion 238 may be guided to the second-b movement preventing portion 218. Accordingly, the knob shaft 201 does not interwork with the knob body 210, thereby preventing the regulating device 90 from operating the heating device.

As is apparent from the above, the cooking apparatus is provided with a shaft guide that is formed in a shaft holder of a knob assembly to guide the knob shaft to prevent a regulating device from operating, so that the knob assembly can be prevented from performing an abnormal operation.

According to the aspect of the disclosure, the cooking apparatus is provided to prevent abnormal operation of the knob assembly, so that safety of use can be improved.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A cooking apparatus comprising:

a heating device;

a regulating device including a regulating shaft and configured to control the heating device according to an operation of the regulating shaft; and a knob assembly provided to operate the regulating device, wherein the knob assembly includes:

a knob body, a knob shaft coupled to the regulating shaft, and a shaft holder provided to move together with the knob body, the shaft holder including a first shaft guide configured to guide the knob shaft to operate the regulating device and a second shaft guide configured to guide the knob shaft to prevent operation of the regulating device.

2. The cooking apparatus of claim 1, wherein:

the first shaft guide is provided to guide the knob shaft when a pressing force is applied to the knob body, and the second shaft guide is provided to guide the knob shaft when the pressing force and a turning force are applied to the knob body.

3. The cooking apparatus of claim 2, wherein the second shaft guide includes:

a second-a shaft guide provided to guide the knob shaft when the pressing force and the turning force are applied to the knob body in a first direction; and a second-b shaft guide provided to guide the knob shaft when the pressing force and the turning force are applied to the knob body in a second direction opposite to the first direction.

4. The cooking apparatus of claim 1, wherein:

the knob assembly includes a shaft protrusion protruded from an outer circumferential surface of the knob shaft, and the first shaft guide and the second shaft guide are provided to guide the shaft protrusion.

5. The cooking apparatus of claim 4, wherein:

the first shaft guide has a groove shape into which the shaft protrusion is inserted, and the second shaft guide has a slit shape configured to be slidable with respect to the shaft protrusion.

6. The cooking apparatus of claim 4, wherein the shaft protrusion includes a material having a strength higher than a strength of the knob shaft.

7. The cooking apparatus of claim 4, wherein the second shaft guide has one end that is open such that the shaft protrusion is inserted into the second shaft guide when the knob shaft is coupled to the shaft holder.

8. The cooking apparatus of claim 1, wherein:

the knob shaft is configured to move together with the knob body when guided by the first shaft guide, and the knob shaft is prevented from moving when guided by the second shaft guide.

9. The cooking apparatus of claim 1, wherein:

the knob shaft is configured to be unlocked to allow rotational movement when the knob shaft is positioned on the first shaft guide, and the knob shaft is configured to remain locked to prevent rotational movement when the knob shaft is positioned on the second shaft guide.

10. The cooking apparatus of claim 1, wherein the second shaft guide includes:

a movement preventing portion formed to extend in a direction that the knob body is pressed; and a rotation preventing portion formed to be inclined with respect to the movement preventing portion.

11. The cooking apparatus of claim 1, wherein a length of the second shaft guide in a direction in which the knob body is pressed is larger than a length by which the knob shaft is moved by being guided by the first shaft guide.

12. The cooking apparatus of claim 1, wherein:

the knob body includes an installation guide provided to guide the shaft holder to a coupling position, and the shaft holder includes a holder installation groove formed to correspond to the installation guide.

13. The cooking apparatus of claim 1, wherein the knob assembly further includes a weight member fixed to the shaft holder and having a weight greater than a weight of the knob body.

14. The cooking apparatus of claim 1, wherein the knob assembly further includes a leaf spring disposed on a portion of the knob shaft to which the regulating shaft is coupled.

15. The cooking apparatus of claim 1, wherein the knob assembly further includes an elastic member provided to elastically support the knob body in a direction away from the knob shaft.

16. A knob assembly comprising:

a knob body;

a shaft holder provided to move together with the knob body; and a knob shaft slidably coupled to the shaft holder, the knob shaft including a shaft protrusion protruded from an outer circumferential surface of the knob shaft, wherein the shaft holder includes:

a first shaft guide configured to guide the shaft protrusion to unlock the knob shaft to allow rotational movement; and a second shaft guide configured to guide the shaft protrusion to cause the knob shaft to remain locked to prevent rotational movement.

17. The knob assembly of claim 16, wherein the shaft protrusion is:

guided by the first shaft guide when a pressing force is applied to the knob body, and guided by the second shaft guide when the pressing force and a turning force are applied to the knob body.

18. The knob assembly of claim 16, wherein the shaft protrusion includes a material having a strength higher than a strength of the knob shaft.

19. The knob assembly of claim 16, wherein the shaft holder is provided to:

move together with the knob body when the shaft protrusion is guided by the first shaft guide, and move relative to the knob body when the shaft protrusion is guided by the second shaft guide.

20. The knob assembly of claim 16, wherein the second shaft guide includes:

a movement preventing portion formed to extend in a direction that the knob body is pressed; and a rotation preventing portion formed to be inclined with respect to the movement preventing portion.

* * * * *